United States Patent [19]

Steenge

[11] 4,300,801

[45] Nov. 17, 1981

[54] METHOD OF SOLUTION MINING SALTS FROM AN UNDERGROUND SALT DEPOSIT

[75] Inventor: Wiecher D. E. Steenge, Amsterdam, Netherlands

[73] Assignee: Shell Internationale Research Maatschappij B.V., Netherlands

[21] Appl. No.: 158,171

[22] Filed: Jun. 10, 1980

[30] Foreign Application Priority Data

Jul. 6, 1979 [NL] Netherlands ..... 7905287

[51] Int. Cl.[3] ..... E21B 43/28

[52] U.S. Cl. ..... 299/5

[58] Field of Search ..... 299/4, 5

[56] References Cited

U.S. PATENT DOCUMENTS 3,355,212 11/1967 Day ..... 299/5
3,433,530 3/1969 Dahns et al. ..... 299/4
3,442,553 5/1969 Kutz ..... 299/5
3,994,531 11/1976 Dillard ..... 299/5
4,007,964 2/1977 Goldsmith ..... 299/5

*Primary Examiner*—Price C. Faw, Jr.
*Attorney, Agent, or Firm*—Jones, Tullar & Cooper

[57] ABSTRACT

Salts from a salt deposit including magnesium and potassium salts are mined by a solution process in a cavity at the lower end of a borehole. A solvent liquid (water) is injected into the cavity at a level that is periodically raised whereby super imposed slices or cuts of the part of the deposit around the borehole are consecutively dissolved. Brine is recovered from a low level in the cavity. The injection rate of the solvent liquid and the recovery rate of the brine are controlled such that the vertical distribution of the potassium content of the brine in the cavity shows a maximum within the uppermost slice or cut.

4 Claims, 1 Drawing Figure

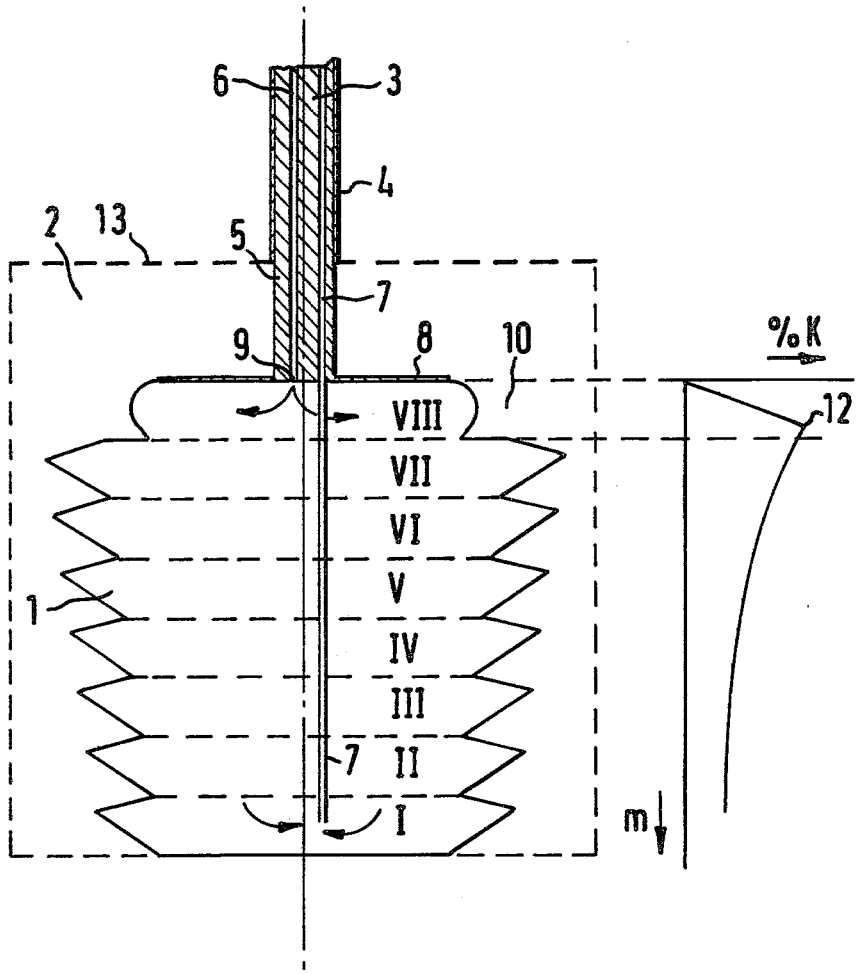
6
3
4
2
13
5
7
9
8
10
%K
12
VIII
VII
VI
V
1
IV
III
7
II
I
m

METHOD OF SOLUTION MINING SALTS FROM AN UNDERGROUND SALT DEPOSIT

The invention relates to a method of solution mining salts from an underground salt deposit including salts of potassium and magnesium, by injecting water via a borehole into the deposit, thereby dissolving salts and forming a brine-filled cavity, protecting the roof of the cavity by an inert fluid layer, and recovering brine from the cavity at a level below the level at which water is injected. The level at which water is injected is periodically raised thereby consecutively dissolving super imposed slices of the part of the deposit around the borehole.

In particular, the present invention relates to a solution mining method suitable for recovering a brine from salt deposits, which brine has a high concentration of magnesium salts. In the majority of cases, these magnesium salts mainly occur in the salt deposits as carnallite ($MgCl_2.KCl.6H_2O$), carnallitite (a mixture of carnallite and halite), kieserite ($MgSO_4.H_2O$), bischophite ($MgCl_2.6H_2O$), kainite ($KCl.MgSO_4.2.75H_2O$) and tachhydrite ($CaCl_2.2MgCl_2.12H_2O$). These salts occur in conglomerate forms or in thin layers alternated by layers of halite (NaCl). The magnesium part, however, can only be recovered by dissolving at least part of the other salts, so that finally (after the mining process is finished) a cavity filled with brine and solids remains.

Each time that the level at which water is injected into the cavity is raised to dissolve a next slice of the part of the deposit around the borehole, the injected water will disperse below the inert fluid layer protecting the cavity roof against dissolution, and the salt deposit will dissolve over the height of the relevant slice in outward direction. The water on dissolving salts will change into brine and the density thereof will increase during the downward displacement of the brine towards the level at which the brine is recovered from the cavity.

Each slice of the deposit is dissolved by the injected water that flows in outward direction with respect to the injection point. The roof of the slice is protected against dissolution by a layer of inert fluid, such as oil. After the slice has obtained the desired radial dimension, the oil layer and the water injection point are raised over a pre-determined distance (for example 5 m) in order to dissolve a fresh slice of the salt deposit. This step is repeated various times until a cavity of the desired height (for example 100 m) has been obtained, at which point the salt mining operation is completed.

The oil layer on top of the water (brine) present in the cavity protects the roof of the cavity from being dissolved, and urges the water that is injected into the cavity to flow radially outwards from the water injection point (which is located close to the oil roof), thereby forming a horizontally extending slice from which the salt is dissolved from the part of the salt deposit around the borehole.

That part of the borehole that is located above the salt layer to be mined is usually lined with a casing and the water injection and brine production are carried out via tubes suspended in the borehole. A separate tube may be used for controlling the oil roof.

By supplying the fresh water at a high level in the cavity and recovering brine from the cavity at a relatively low level the density of the brine will increase during its downward displacement to the level at which it is recovered from the cavity.

In solution mining methods of the above-mentioned type the cavity wall will continuously be dissolved over the total height thereof which will result in a conically-shaped cavity having the largest cross-section near the lower part thereof. Cylindrically shaped cavities, however, are preferred to guarantee a safe roof support for the production period and to prevent that contact is made with adjoining cavities from which brine has been recovered or is being recovered.

The object of the present invention is a solution mining method enabling formation of a cavity of a substantially cylindrical shape, and the recovery of a brine with a relatively high magnesium content.

According to the invention, there is provided a method of solution mining salts from an underground salt deposit including salts of potassium and magnesium by injecting water via a borehole into the deposit thereby dissolving salts and forming a brine-filled cavity, protecting the roof of the cavity by an inert fluid layer, and recovering brine from the cavity at a level below the level at which water is injected, wherein the level at which water is injected into the cavity is periodically raised thereby consecutively dissolving super imposed slices of the part of the deposit around the borehole. The water injection rate and the brine recovery rate are controlled such that the vertical distribution of the potassium content of the brine in the cavity shows a maximum within the uppermost slice.

By "control of the water injection rate and brine recovery rate" is to be understood the control of the quantity of water supplied and the control of the quantity of brine recovered per unit of time at any moment of the control period. The rate at which the liquid flows through the cavity can be influenced by this control.

As will be further explained hereinbelow, the residence time of the liquid in the uppermost or top slice plays an important role in the formation of the cavity.

It has been found that the solid salts of the deposit are dissolved in the fresh water injected into the cavity in about the ratio in which they present themselves to the injected water. The potassium and magnesium contents (and also the sodium content if sodium salt is present in the deposit) of the solvent liquid gradually increase and the salt in the top slice is gradually further dissolved. When the brine thus formed has reached a certain degree of saturation, the potassium content thereof will decrease, whereas the magnesium content will still further increase but at a reduced rate. Thus, after a maximum has been reached in the vertical distribution of the potassium content of the brine present in the uppermost slice of the part of the salt deposit around the borehole, magnesium salts will continue to be dissolved in the brine, whilst simultaneously therewith potassium salts are being precipitated from the brine. Any sodium salts present in the brine will also be precipitated therefrom. These salts either precipitate on the cavity wall or settle down in the cavity in crystalline form.

Further, it has been found that a brine—which contains such a quantity of magnesium salts that potassium salts (and sodium salts if present) precipitate therefrom if a further quantity of magnesium salts is dissolved—is incapable of dissolving the cavity wall in a uniform manner. Leaching of the cavity wall with such a brine that precipitates potassium (and sodium) salts is found to take place in a selective manner, whereby the magnesium rich layer, veins and crystals are dissolved and the other parts of the wall remain intact (or crumble away and settle at the bottom of the cavity).

In the method of the present invention the cavity is formed by consecutively dissolving slices of salt at the top of the cavity with a solvent liquid which reaches the maximum concentration of potassium in the uppermost slice that is being formed. The cavity wall below the uppermost slice is thereby dissolved by a brine from which potassium salts precipitate, and this dissolution thereby yields a more concentrated magnesium-containing brine. In order to obtain the most advantageous cavity shape, the lower slices of the cavity should initially be dissolved during the formation thereof with a relatively small diameter and the diameters of the super imposed slices should be increased stepwise in the relevant formation periods. During the continued leaching of the cavity wall, the slices will increase in diameter and a cavity will finally be obtained having a substantially cylindrical shape, of say 100 m diameter.

It is preferred that the maximum potassium content is located at one-third of the slice height above the lower boundary of the top slice.

In carrying out the present process, the potassium content of the solvent liquid at various levels in the cavity is periodically or continuously determined, whereby a "potassium profile" across the cavity and in particular across the top slice thereof is obtained. The water injection rate and the brine recovery rate are then controlled such that the maximum value of the potassium profile is within the top slice (including the lower boundary thereof).

Information on the potassium profile is found to be imperative in order to ensure dissolving of the cavity wall under the most favourable conditions.

Since the area of the salt exposed to the liquid solvent during the dissolution of a slice is not constant, and often the composition of the exposed salt also varies, a close watch should be made on the variations of the potassium profile over the dissolving process. A number of techniques are available for this purpose. One way of determining the potassium content of the brine is by radiographic measurement of the concentration of radioactive potassium isotope. This yields reliable and rapidly available results, so that rapid control of the water injection is also possible. For the radiographic determination gamma radiation can be measured.

It will be appreciated that the two following zones can be distinguished at any moment in the cavity wherein the present method is being carried out:

1. an upper zone in which the brine is not yet saturated with potassium salts and in which the cavity wall is dissolved in a non-selective manner, and
2. a lower zone in which the contents of magnesium salts is so high that potassium salts precipitate if further magnesium salts are dissolved and in which the cavity wall and the lumps of salt detached from the cavity wall and descending in the liquid-filled cavity, are dissolved selectively (that is only the magnesium salts are dissolved). The dissolution rate of the magnesium salts in the lower zone is smaller than the dissolution rate of the magnesium salts in the upper zone.

If desired, the use of the present method may be restricted to the initial phase of forming a cavity in a salt deposit, whereby the potassium profile is only determined (periodically or continuously) when forming a lower set of slices of the cavity. The initial phase in the life of a cavity in which the lower set of slices is made is considered the most critical, since then only a small area of salt is exposed to the solvent liquid and the inherent advantages of the application of the invention are then greatest. After this initial phase the remaining (higher) slices can then be made, for example, while water is injected at a constant throughput.

The invention will be described by way of example with reference to the drawing in which a diagrammatic longitudinal section of a half-completed cavity and the lower part of a borehole are shown, and wherein the potassium profile over the liquid in the cavity is indicated on the right.

The drawing shows the cavity 1 at a certain moment of its formation in a salt deposit 2 including salts of magnesium, potassium and sodium. The slices I–VII have been dissolved in earlier stages of the process in the deposit 2, and the slice VIII is still in the dissolution period thereof. The cavity 1, which may be located at a depth of say 1500 m, communicates with the earth's surface via a borehole of which part 3 is lined with a casing 4 and of which uncased part 5 extends through the still undissolved part of the salt deposit 2.

A water injection tube 6 and a brine production tube 7 extend through the borehole. The tube 6 debouches near the top of the cavity 1 and the tube 7 debouches at a short distance from the bottom of the cavity.

The tube 6 terminates in the upper region of the cavity at the level 9, and the borehole as well as that volume of the cavity 1 located above the lower end of the tube 6 are filled with oil, so that an oil roof 8 is formed that will radially grow in size when the slice VIII expands into the zone 10 by the dissolution of the salt from this zone by the water injection via the tube 6.

The radial size of the slice VIII is determined periodically or continuously in a known manner, such as by sonar measurements. When the desired radial extension of the slice VIII has been reached, the water injection and brine production are discontinued. The water injection tube 6 and the oil roof 8 are raised over a pre-determined distance that corresponds with the desired height of the next slice (not shown) that is to be dissolved from the deposit, and which slice is to be super imposed on the slice VIII.

Subsequently, the water injection (through tube 6) and the brine production (through tube 6) are re-started and during this next cycle, as well as during further cycles continuous care is taken that the potassium content of the liquid in the cavity has the vertical distribution as shown in the drawing, i.e. exhibits a maximum within the top slice.

In the area above the level 12 at which the maximum potassium content of the liquid is present, the liquid dissolves the salt in the zone 10 in a non-preferential manner so that the potassium and magnesium contents of the liquid continuously increase in downward direction.

In the area below the level 12 the liquid dissolves magnesium salts from the cavity wall in a preferential manner, whereas potassium and sodium salts are precipitated from the solution. Consequently, the potassium content (% K) decreases in downward direction, as shown in the drawing.

The wall of the cavity 1 will thereby acquire a profile as shown diagrammatically. Each slice remains recognizable to some extent. The wall of the cavity at the level of slices that have been dissolved in an earlier stage of the process will continue to be dissolved, whereby the contours of the slices will fade.

When, after a number of cycles, the level 9 at which water is injected into the cavity has reached the top 13 of the part of the deposit that is to be mined, the recovery of brine from the cavity is stopped after the final top slice has been dissolved. The supply of solvent liquid is also stopped and the cavity is kept under liquid pressure and sealed. After the permanent liquid filling in the cavity has been saturated, the cavity wall will no longer be dissolved and the cavity may be abandoned without any problems.

By the method according to the invention it is possible to mine a formation containing, for example, an average of 50% by weight of magnesium salts in such a manner that a brine with more than 15% by weight of magnesium salts is produced.

Cavities with a diameter of 100 m can be made in a salt deposit, 30–100% of which consists of carnallite, with a brine production rate of 3–30 $m^3/h$. The slice height is then preferably 3–10 m.

I claim:

1. Method of solution mining salts from an underground salt deposit having a substantially uniform composition including salts of potassium and magnesium by continuously injecting water via a borehole into the deposit thereby dissolving salts and forming a brine-filled cavity, protecting the roof of the cavity by an inert fluid layer, and continuously recovering brine from the cavity at a level close to the bottom of the cavity, wherein the level at which water is injected into the cavity is periodically raised thereby consecutively dissolving superimposed slices of the part of the deposit around the borehole, and controlling the water injection rate and the brine recovery rate such that the vertical distribution of the potassium content of the brine in the cavity shows a maximum within the uppermost slice and the vertical distribution of the magnesium content increases from the uppermost slice to the lowermost slice, each higher slice being initially formed with a diameter which is larger than that of the adjacent lower slice, the difference in initial slice diameters being such that the continued leaching in the lower slices, during initial formation of the uppermost slice, will increase the diameter of the lower slices until each lower slice has substantially the same diameter and a substantially cylindrical cavity is formed.

2. Method of solution mining salts from an underground salt deposit including salts of potassium and magnesium by injecting water via a borehole into the deposit thereby dissolving salts and forming a brine-filled cavity, protecting the roof of the cavity by an inert fluid layer, and recovering brine from the cavity at a level below the level at which water is injected, wherein the level at which water is injected into the cavity is periodically raised thereby consecutively dissolving superimposed slices of the part of the deposit around the borehole, and controlling the water injection rate and the brine recovery rate such that the vertical distribution of the potassium content of the brine in the cavity shows a maximum within the uppermost slice located at one-third of the slice height.

3. Method as recited in claim 2, in which the potassium content is determined by radiographic measurement of the concentration of radioactive potassium isotope.

4. Method of solution mining salts from an underground salt deposit including salts of potassium and magnesium by injecting water via a borehole into the deposit thereby dissolving salts and forming a brine-filled cavity, protecting the roof of the cavity by an inert fluid layer, and recovering brine from the cavity at a level below the level at which water is injected, wherein the level at which water is injected into the cavity is periodically raised thereby consecutively dissolving superimposed slices of the part of the deposit around the borehole, and controlling the water injection rate and the brine recovery rate such that the vertical distribution of the potassium content of the brine in the cavity shows a maximum within the uppermost slice, the potassium content being determined by radiographic measurement of the concentration of radioactive potassium isotope.

* * * * *